United States Patent [19]

Espinosa

[11] Patent Number: 4,938,608

[45] Date of Patent: Jul. 3, 1990

[54] DOUBLE-SECTION PLASTIC PRODUCE BAG

[76] Inventor: Daniel Espinosa, 4425 Lonardo Ave., San Jose, Calif. 95118

[21] Appl. No.: 452,215

[22] Filed: Dec. 18, 1989

Related U.S. Application Data

[63] Continuation-in-part of Ser. No. 185,978, Apr. 25, 1988.

[51] Int. Cl.[5] ..... B65D 30/22; B65D 33/06

[52] U.S. Cl. ..... 383/7; 383/37; 383/38

[58] Field of Search ..... 383/77, 7, 8, 38, 40, 383/37

[56] References Cited

U.S. PATENT DOCUMENTS

| | | | |
|---|---|---|---|
| 2,197,113 | 4/1940 | Piazze | 383/35 |
| 2,956,035 | 10/1960 | Mock | 383/35 |
| 3,052,399 | 9/1962 | Brown | 383/77 |
| 3,321,125 | 5/1967 | Quackenbush et al. | 383/35 |
| 3,645,822 | 2/1972 | Widiger et al. | 383/35 |
| 3,762,542 | 10/1973 | Grimes | 383/37 |
| 3,774,838 | 11/1973 | Christie | 383/77 |
| 3,961,743 | 6/1976 | Hollowell | 383/37 |
| 4,164,170 | 8/1979 | Nordin | 383/37 |
| 4,345,712 | 8/1982 | Gim | 383/37 |
| 4,445,230 | 4/1984 | Spadaro | 383/77 |

FOREIGN PATENT DOCUMENTS 2042469 9/1980 United Kingdom ..... 493/926

*Primary Examiner*—Stephen P. Garbe

*Attorney, Agent, or Firm*—Jacques M. Dulin; Mesner H.

[57] ABSTRACT

Dual-section ultra-thin (0.1–0.8 mil) plastic produce bags having a large upper compartment with an open top boundary (fill opening) and a bottom boundary that is partially open to a smaller lower section. The bags are provided in a series on a roll enabling dispensing of each bag by unrolling and tearing along a line of perforations. Individual plastic bags are defined by lines of adjacent heat seals and perforations on a flattened plastic tube. Two elongated side straps have ends attached to the bag adjacent to the top opening so that the top opening of the bag may be closed by tying the straps together. The straps are generally trapezoidal in shape with the widest dimension of the trapezoid being 50–60% the width of the bag at the junction line of the strap to the bag. This design provides strength to the attachment of the strap to the bag in order that the straps may also be used as a handle for carrying the bag. The width of the strap at its smallest dimension is at least as large as the human thumb length and 40–50% the bag width in order to facilitate opening the bag. The lower section is from 10–40% the volume of the upper main bag section. The dual section design permits placing smaller produce items, or a very few larger ones in the lower section alone, or loading larger produce items in the upper section.

4 Claims, 1 Drawing Sheet

DOUBLE-SECTION PLASTIC PRODUCE BAG

CROSS REFERENCE TO RELATED APPLICATION

This application is a continuation-in-part of application Ser. No. 185,978 filed April 25, 1988 priority of which is claimed under 35 U.S.C. §120.

FIELD

The invention relates to dual-use, double-section plastic produce and bulk food bags, and particularly to ultra thin (0.1 to 0.8 mil) produce and bulk food bags that are provided as full width (non-edge folded) on a continuous roll with tear perforations between successive bags for use by customers who tear off and bag their own produce. The invention is particularly concerned with the provision of a double-section bag having a clearly defined single top opening, a large top compartment portion for large produce items, and a connected lower compartment portion for smaller or fewer produce items.

BACKGROUND

Typically, plastic bags for use at point-of-sale in markets are manufactured from an extruded tube of plastic, such as polyethylene, heat sealed and perforated at spaced intervals along the length of thee tube. The tube is then rolled into tubular configuration for packaging and sale purposes. Each bag is subsequently individually removed as needed, by tearing it off along the perforations. Alternately, in some instances, the tube of plastic is cut rather than perforated, permitting the bags to be folded and placed into a dispensing container for individual removal at the time of use.

In either case, the bag must be opened and various means have been tried by the user or customer in attempting to separate the sides of the bag. A user's thumb and forefinger can be placed on opposite sides of the bag and rubbed together. A diagonal cut or tear can also be provided across an edge of the bag, or a fingernail can be pressed between the bag walls However, the mouth of the bag is usually not marked. Accordingly, the customer's attempts to open the bag often are inadvertently directed to the bottom of the bag. Under these circumstances, to say that opening the bag may be frustrating or cumbersome, is like saying that the Watergate break-in was just another burglary. Neither term adequately describes the situation.

Even after the bag has been opened and filled, it must be closed, and various means are available for maintaining the bag in a closed condition. Paper or plastic covered wire ties and/or plastic straps or notched tab closures are usually provided for use as a closure for such bags. However, the use of these closing means requires that the bag be closed with one hand while the closures are applied with the other. This usually proves to be a cumbersome task. In addition, the wire tie or plastic straps are typically stored separately from the bags and are easily misplaced, or the number mismatched.

To overcome the problem of misplaced closure means, various bags, principally heavy weight garbage or leaf bags have been designed with integral tying means. The utilization of such integral tying means often requires that the user of the bag perform the additional act of removing the integral tying means from the bag before using same.

One of the inherent disadvantages of the bag having integral tie means is the shape of the closures. E.g., if the closing means is in the form of slender ears such as in Hollowell 3,961,743 their widths are much less than their length. Thus, the ears can easily tear along their bases during the step of tearing the bag off the roll, during the tying process, or when being used as a carrying handle. In addition, the wide central portion of the bag often remains shut after being separated from its adjacent neighboring bag. Opening of the central portion can be a duplication of the frustrating attempts previously described.

Furthermore, inasmuch as the relatively narrow ears of Hollowell 3,961,743 also determine the configuration of the bottom portion of the adjacent bag on the roll, the bottom portion of each bag has an extremely long seam and contains corners which typically remain unfilled or partially filled during the filling process resulting in a bag which, in general, is not filled to its theoretical capacity. Lastly, the bag is difficult to manufacture due to the narrow ears and because the design requires the transverse shifting of one layer of plastic relative to the other layer of plastic forming the bag so that the tying ears can be formed.

Produce bags are provided in rolls of very thin plastic material which is of insufficient strength, and bags are of too small size, for bagging groceries. They are simple double-layer (flattened tube), full-width bags. That is, there are no multiple-layer edge folds to provide bags, which upon opening, are wider than the roll. They are formed in the roll by simple transverse perfs and seals so the bags are essentially square. The top and bottom are indistinguishable which leads to consumer confusion and great difficulty to open the bags for use. That results in wadage as many bags are torn at the bottom by frustrated consumer attempts to open the bags, thinking they are working on the top.

Further, the exceedingly thin plastic, on the order of 0.1 to 0.3 mils or less, is so thin that the compression of winding the bags on the roll, the inherent self-adhesion effect of two clean surfaces touching, and electrostatic forces make opening the bags difficult. Just about everyone has experienced frustration and great difficulty in trying to open such ultra-thin produce bags without tearing, or in a parallel experience, trying to unfold cheap thin plastic drop "cloths" in which the plastic is so thin one cannot tell whether there are one or more layers, and separation without tearing is next to impossible.

Further, to my knowledge, no one has provided a produce bag with integral ties. Clearly, using heavyweight plastic grocery bags is uneconomic as each shopper uses multiple produce bags to separate different items of produce. And plastic grocery bags are too large and wasteful. The proliferation of plastic grocery bags in landfill is already a serious waste management problem, and use of plastic grocery bags for produce use would enormously magnify that serious problem.

Because of the foregoing, it has become desireable to develop an inexpensive, easily manufactured ultra thin plastic produce bag which can be easily opened and which can be closed by a pair of integral straps each having high tear strength. The configuration of the bag is such that it provides dual use, having a single obviously defined mouth opening into a large upper compartment portion for large produce objects, and a connected lower portion for smaller or fewer produce objects.

SUMMARY

In accordance with the invention, a flattened tubular double layer strip of ultra-thin (.1 to .8 mil) plastic is provided that is releasable as individual plastic produce and bulk food bags from a roll. As seen in FIGS. 1 and 2, each bag comprises a heat seal across a remote bottom and a severed series of perforations across the top, the later defining congruent central sections and a pair of tie/carry straps. The straps are on opposite sides of the central sections and each is trapezoidally shaped, being of such width to form in the adjacent preceeding bag, a dual-section bag body with a large upper compartment portion opening at its bottom to a smaller lower section or portion.

In a flattened configuration, each strap comprises congruent angular front and rear regions. Each region itself is also trapezoidally shaped and includes a side seam foldline that is non-parallel to an opposite obtuse angled side that was originally a part of the top line of severance of the individual bags. Remaining sides of the trapezoid are parallel to each other and intersect the side seam foldline at 90 degrees.

Minimum width W of each strap (at the narrowest part of each of the angular regions) must be large enough to accommodate a human's thumb on one side and a finger on the other. In that way, sufficient friction force can be developed to assure the opening of the bag. Likewise, as can be seen in FIG. 5 the straps must be of sufficient length L that they can be brought together and tied to close the bag, and of sufficient width that the tied straps are strong enough, given the ultra thin nature of the plastic to be strong enough to function as a handle for heavy produce items.

The bags are formed integrally as part of a tubular strip wound in a roll so that individual bags may be removed along perforations adjacent to the top of the bag. Alternately, the strip can be die cut and the individual bags separated out and folded before use.

The method of the invention comprises the steps of extruding a plastic tube, expanding the tube to the desired bag diameter, flattening the tube to form the side seams without side folds (pleats or tucks), forming transverse heat seals and perforations at equally spaced intervals along the strip in a pattern that produce a pair of trapezoidal shaped straps on opposite sides of congruent central sections, and using the width of at least one of the straps to open each bag by friction forces. The strap pattern is characterized by tapered sides of the trapezoid being used to vary the width dimension of each strap wherein the minimum width (aligned with the upper ends of the trapezoid) are large enough to support the user's thumb and finger. As a result when a bag is torn from thee roll, friction forces can be developed at each strap to open the bag.

BRIEF DESCRIPTION OF THE DRAWINGS

FIG. 1 shows a plan view of an unrolled section of the bag roll of FIG. 1, illustrating how a bag is removed and opened;

DETAILED DESCRIPTION OF THE BEST MODE OF THE INVENTION

The following is a detailed description of preferred embodiments of the present invention by way of example only and is not intended to limit its applicable principles. Furthermore, the description is intended to clearly enable one skilled in the art to make and use the invention. It also includes various adaptions, variations, alternatives and different uses of the invention including what we presently believed to be the best mode of carrying out the invention.

Figure 1:
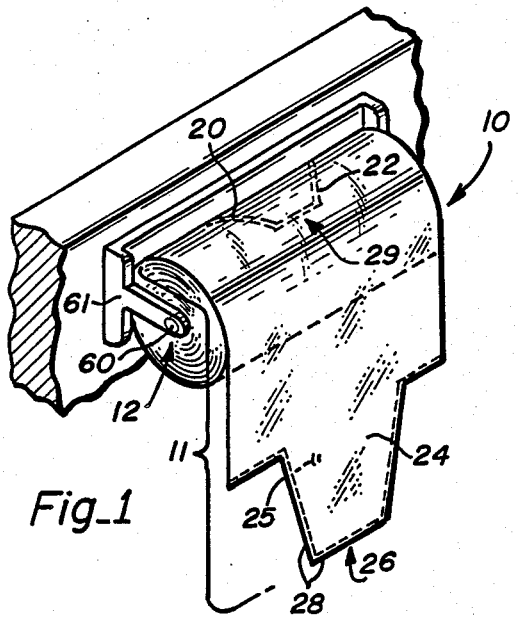
FIG. 1 is a perspective view of a roll of plastic bags of the invention attached to a shelf at the produce point-of-sale in a market or shop.
Figure 2:
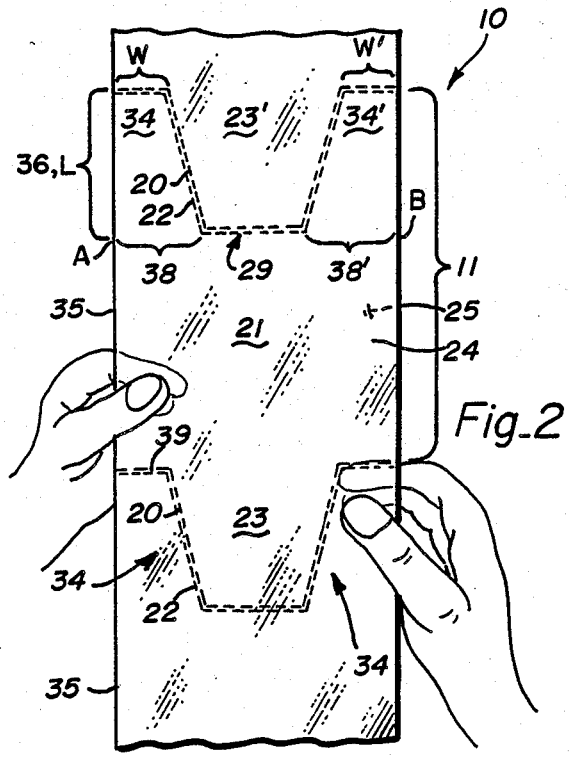
FIGS. 2*a*, 3 and 4 are fragmentary views of the top segment of the bag of the invention illustrating in more detail the shape and operations of straps during opening.

Referring first to the embodiment of FIGS. 1 and 2, the reference numeral 10 indicates generally an extruded strip of ultra thin plastic, e.g. polyethylene or other conventional bag plastic, which has been expanded to form the desired bag diameter, by the method of the invention and then flattened. Note there are no side pleats; the tube is a simple doublelayer tube. The extruded strip 10 is next heat sealed and then partially perforated to form adjacent pairs of seams 20 and a series of perforations 22 and rolled into a roll 12 5 (FIG. 1). Each pair of seams 20 and perforations 22 are positioned from neighboring pairs by a constant longitudinal distance along the length of the strip 10. In the transverse direction, each pair is continuously configured in parallel planes that intercept both front and rear sheets 24, 25 of the strip 10. In the alternative, the strip 10 can be completely cut along the series of perforations 22 so as to produce individual bags 11 rather than have the strip 10 being used in the form of roll 12.

Figure 3:
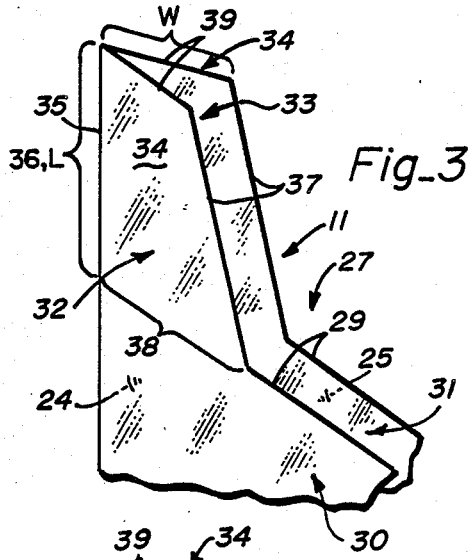

When an individual bag 11 is formed, the seam 20 is adjacent to the bottom 26 of the bag 11 of FIG. 1 while its paired perforation 22 does in fact form the bottom 26. The upper perforation 22 of a neighboring pair is used to provide the operable top 27 of the bag 11 (see FIG. 3). As a result, top and bottom lines of severance 28 (FIG. 1) and 29 (FIG. 3) provided by tearing along the associated series of perforations 22, are coincident with the top 27 (FIG. 3) and bottom 26 (FIG. 1) of each bag 11. Each line of severance 28, 29 in a front view as shown in FIG. 2, has a "winged" shape resulting in a large upper portion or section 21 opening at its bottom end into a smaller, lower section or portion 23. As seen in FIG. 3, front and rear central sections 30, 31 are provided over the central region of each bag 11. The front central section 30 is seen in FIG. 3 to comprise a portion of the front segment 24, while the rear central section 31 is part of the rear segment 25. Each front and rear central section 30, 31 is also flanked by pairs of congruent regions 32, 33 that form an elongated strap 34. Each strap 34 is trapezoidally shaped whether viewed from the front as in FIG. 2 or from an expanded edge view as in FIG. 4. In the flattened view of FIG. 4, common side 36 of the front and rear trapezoids coincides with the upper of part of side seam foldline 35. While in the expanded fragmentary view of FIG. 4, the single trapezoid is centered at the side seam foldline 35.

Returning to the flatten view of the bag 11 shown in the perspective view of FIG. 3, each strap 34 is seen to include the congruent regions 32, 33 previously described but each trapezoid is configured so that the common side 36 is not parallel to obtusely angled sides 37. The obtusely angled sides 37 are also part of the top line of severance 29. Parallel sides of each trapezoid comprise an imaginary side 38 that extends from a portion of the top line of severance 29 of the upper edges of the central sections 30, 31, and an upper closing terminus 39. Both sides 38, 39 intersect in one direction the side seam foldline 35 at 90 degrees and in the other direction, the ends of the obtusely angled side 37. Note that the terminus 39 as well as the obtusely angled side 37 form a part of the top line of severance 29.

Figure 2A:
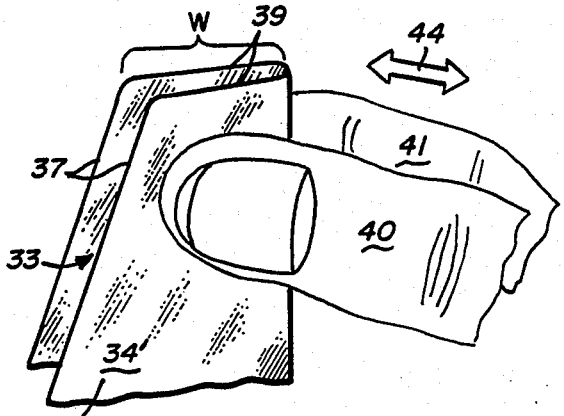
Figure 4:
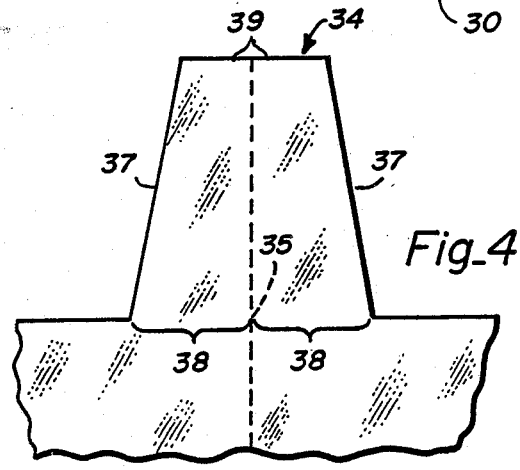

In the fragmentary view of FIG. 4, the single trapezoid is differently configured then those of FIGS. 2*a* and 3. As shown the obtusely angled sides 37 form both of the nonparallel sides of the trapezoid. While the parallel sides comprise composite termini 39 and composite imaginary sides 38 as shown.

In either view, each strap 34, 34' is seen to define varying width dimensions between the non-parallel sides whether such sides be the common side 36 and obtusely angled side 37 of the flattened bag 11 of FIG. 2, or the obtusely angled sides 37 of the expanded bag of FIG. 4. But in each view, the exact width dimensions of each strap 34 are of importance.

As shown FIGS. 2 and 2*a* or both strip 10 and bag 11, the narrowest part of each strap 34, viz., at the transverse closing terminus 39, there must be sufficient space to accommodate the user's thumb 40 and his finger 41 on opposite sides. As a result, sufficient friction can be developed (as the thumb 40 and finger 41 undergo relative movement in the directions of double arrow 44) to cause the front and rear regions 32, 33 of each strap 34 to move relative to each other. Although movement of the thumb 40 and the finger 41 is usually relative to the side seam foldline 35, the opening between the front and rear regions 32, 33 is usually across the transverse termini 39. However, in some circumstances, such opening occurs across the obtusely angled side 37, such as when the thumb 40 and finger 41 are placed in congruent locations closely adjacent to the sides 37.

Common length L of the straps 34 must be long enough to span the mouth of each bag 11 with enough overlap to permit the straps 34 to be tied together. As shown in FIG. 1 they are 55–65% the Width A-B, and about 40% the length B of the bag. In addition, there must be sufficient material across the non-parallel sides 36, 37 to permit each strap 34 to withstand usual closing pressure that accompanies the tieing to the straps together.

As best seen in FIG. 2 the trapezoidal side strap members 34 and 34' together have a base width 38, 38' from 50–60% of the total width of tube, i.e. the width between points A and B, which includes strap base widths 38, 38' plus the width 29 of the bottom portion of the lower bag portion of section 23' of the preceding bag. Conversely, the top width W plus W' of the trapezoidal side strap members 34 and 34' have a width of from 40–50% of the width of the tube (dimension A-B in FIG. 2).

The width and length dimensions are very important to the invention as the plastic is ultra thin. The width W at the top of the handle where torn off the roll permits bag opening as show in FIG. 2*a* (see back-and-forth rubbing arrow 44). The strap base width is wide to provide carrying strength of heavy produce objects. The length L of the straps permits tieing. The relative ratios of the length L to the bag height 11 provides an ample lower small bag portion 23 that is approximately 10–40% the volume of the upper main section 21. The trapezoidal configuration of the side straps is not incidental; they provide strong tieable straps and a dual-section bag configuration.

Below the top line of severance 29, each bag 11 spreads out so as comprise congruent panels of generally rectangular shape as viewed in FIG. 2. There panels are seamed along the longitudinally extending side seam foldlines 35 as previously mentioned. Such foldlines 35 terminated at the bottom 26 of each bag at the bottom line of severanoe 28 of FIG. 1.

Figure 5:
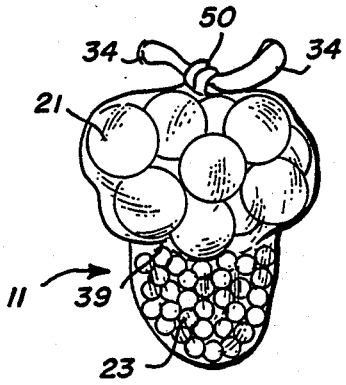
FIG. 5 is a perspective view of the bag of the invention in which the straps of FIGS. 2*a*, 3 and 4 are tied together showing smaller produce items in the lower section and larger produce items in the upper section.

After the extruded strip 10 has been flattened to the bag diameter, the pairs of seams 20 and series of perforations 22 are formed in "winged" configurations at spaced locations along the strip 10. Then the strip 10 is rolled into a tubular rolled form so as to provide the roll 12 of FIG. 1 and shipped to a point-of-sale market or shop. After shipping, the roll 12 can be unpacked and mounted to a roller 60 of a dispenser 61. Thereafter, each bag 11 can be removed by a user, as needed by tearing along the first available series of perforations 22. The bottom 26 of the removed bag 11 is adjacent to a bottom seam such as seam 20 of FIG. 1. The top 27 of the bag will have the same "winged" configuration as that of the bottom 26 but will not have an adjacent sealed seam. Each time a bag is removed from the roll 12, the next bag will be formed with the proper configuration. Then the user places his thumb 40 and finger 41 in the manner of FIG. 2*a* in a congruent locations on front and rear regions 32, 33 of one of the straps 34. As a result, friction forced (arrow 44 in FIG. 2*a*) can be generated to cause the regions 32, 33 to move relative to each other and establish an opening that intercepts a plane coincident with a portion of the top line of severance 29. After the bag has been filled with goods as shown in FIG. 5, the straps 34 can be brought together and tied in a knot. Note in FIG. 5 that smaller or fewer produce items, (such as cherries, grapes, nuts, trail mix, candies, dried fruit, etc.) are located in the lower small section 23, and larger product items, such as grapefruit, melons, broccoli etc., in the upper section. The tying process draws the sides of the bag 11 inwardly towards each other. The varying width of the straps 34 is sufficient to withstand the closure pressure as the knot 50 is being formed, and minimize the chance of accidental spillage.

Alternatively, if the extruded strip 10 is cut along the series of perforations 22 as the final manufacturing step, the resulting bags can be folded and placed in a box (not shown) for shipment to the point-of-sale market or shop. The individual bags are opened in the same manner as previously described.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. A dual-section produce and bulk foods bag of ultra-thin plastic formed as a tube flattened to form a dual-layered sheet having parallel side margins without side pleats, comprising in operative combination:

(a) individual dual-section bags defined in a sequential series in said tube by adjacent parallel scoring and heat sealing lines;

(b) each of said bags having a lower bag section with a closed bottom end and opposed closed sides formed by a continuous heat seal;

(c) said lower section closed sides being spaced inwardly from said parallel tube side margins and oriented at an angle thereto to define a pair of opposed, spaced trapezoidal side strap members between said lower section sides and said tube parallel side margins;

(d) an upper bag section having a bottom end, opposed closed sides coordinate with said tube parallel side margins, and an open upper end;

(e) said upper bag section bottom having a pair of opposed closed segments, and an opening transverse to said bag sides in communication with and coextensive with said upper open end of said lower bag section;

(f) said transverse opening of said upper bag section bottom comprising 50-60% of the width of said tube;

(g) said upper bag section upper end terminating on opposed sides thereof in said trapezoidal side strap members;

(h) said trapezoidal side strap members together having a base width comprising from 50–60% of the width of said tube at said transverse upper bag section bottom opening, and said trapezoidal members together having a top width comprising 40–50% of the width of said tube;

(i) said trapezoidal side members and said transverse upper bag section top opening being formed by scores spaced from said continuous heat seal line that forms a lower bag section of a next adjacent bag;

(j) said trapezoidal strap side members being of sufficient length to form opposed spaced tieable straps for closing and carrying said bag when filled with produce; and (k) said lower bag section being smaller than said upper bag section, said lower bag section being from about 10 to about 40% of the volume of the upper bag section to permit retention of a plurality of small articles or a few larger articles without damage from being loose in an oversize bag, and said upper bag section permitting retaining additional ones of said larger articles in addition to, or separate from, said smaller articles.

2. A dual section produce bag as in claim 1 in which said side strap length is from 55–65% the width of the bag in the flattened condition.

3. A dual section produce bag as in claim 1 in which said plastic has a thickness on the order of about 0.1 to 0.8 mils.

4. A dual section produce bag as in claim 2 in which said plastic has a thickness on the order of about 0.1 to 0.8 mils.

* * * * *